United States Patent [19]

Matsushita et al.

[11] 4,045,292

[45] Aug. 30, 1977

[54] METHOD FOR CONTROLLING COMBUSTION IN COKE OVEN BATTERY

[75] Inventors: Taro Matsushita, Fukuyama; Masahiro Hiraki, Fukayasu; Takeo Fujimura, Yokohama; Shinji Hasebe, Fukuyama, all of Japan

[73] Assignee: Nippon Kokan Kabushiki Kaisha, Tokyo, Japan

[21] Appl. No.: 701,150

[22] Filed: June 30, 1976

[30] Foreign Application Priority Data

July 21, 1975 Japan ..... 50-88430

[51] Int. Cl.[2] ..... C10B 21/10

[52] U.S. Cl. ..... 201/1; 23/230 A; 202/151; 236/15 E

[58] Field of Search ..... 201/1; 23/230 A, 253 A, 23/259.5; 236/15 E; 202/151

[56] References Cited

U.S. PATENT DOCUMENTS

| | | | |
|---|---|---|---|
| 3,607,660 | 9/1971 | Kumper | 201/1 |
| 3,993,447 | 11/1976 | Buzz et al. | 23/259.5 |

OTHER PUBLICATIONS

Savas, E. S., Computer Control of Industrial Processes, N. Y., McGraw-Hill, 1965, pp. 147-153.

*Primary Examiner*—R.E. Serwin
*Attorney, Agent, or Firm*—Flynn & Frishauf

[57] ABSTRACT

In the operation of a conventional coke oven battery, a target flue temperature for each oven group is set on the basis of details of coal charge consisting of the weight, the particle size, the moisture content, the volatile matter content and the timing of charging of the coal charge, so as to achieve a target net coking time and a target soaking time given by a coke production schedule. Then, the temperature is measured for individual flues at certain intervals of time and deviations of thus measured flue temperatures from said target flue temperature are calculated by computer, to set a flow rate and a calorific value of the fuel gas for each oven group. A stack draft is set and controlled by computer so that an optimum combustion may take place in response to changes in the flow rate and the calorific value of the fuel gas. Said target flue temperature is furthermore bias-corrected with the use of a mean measured flue temperature, measured net coking times, measured soaking times and the details of coal charge corresponding thereto.

4 Claims, 2 Drawing Figures

METHOD FOR CONTROLLING COMBUSTION IN COKE OVEN BATTERY

FIELD OF THE INVENTION

The present invention relates to a method for controlling the combustion in a conventional coke oven battery with the use of a computer.

BACKGROUND OF THE INVENTION

A conventional coke oven battery for producing metallurgical coke comprises coking ovens for carbonizing a coal charge, combustion chambers for causing combustion of a fuel gas, regenerators for storing the remaining heat of a combustion waste gas and sole flues for guiding the combustion waste into a stack. The coking ovens and the combustion chambers are alternately arranged on the regenerators and thus form an oven group belonging to a single combustion system. A huge coke oven battery comprises a plurality of oven groups. Each combustion chamber comprises many flues where a fuel gas is burnt. Coke is produced by heating and carbonizing a coal charge in the coking ovens on the both sides of the combustion chamber through oven walls by said combustion. The fuel gas and the air are sent, after being heated in the regenerators, to the combustion chambers and burnt. Combustion waste gases from the flues are discharged from the stack through the sole flues after heating and regenerators. For the purpose of repeating said regeneration and said preheating of the fuel gas and the air at a high efficiency, the flow direction of the combustion waste gases and the flow direction of the fuel gas and the air are switched over into the reverse direction at certain intervals in time.

In said operation of a conventional coke oven battery, the combustion control is the most important factor with a view to manufacturing a coke of a high quality consistently, reducing the heat consumption, keeping the coke oven battery always in a satisfactory state, and carrying on smooth operations of the coke oven battery.

The conventional method for controlling the combustion in the coke oven battery generally comprises the following steps:

a. setting target temperatures of the individual flue bottoms corresponding to a target net coking time (a target interval of time from coal charging to coking completion) given by a coke production schedule, with reference to the past results and experience;

b. manually measuring the bottom temperature of many flues with optical pyrometers about three times a day, and numerically controlling the mean value of said measured temperatures with reference to said target flue temperature, about three times a day;

c. manually measuring, on the other hand, the net coking time for the individual coking ovens, and numerically controlling the mean value within an operating shift of said measured values of time with reference to said target net coking time, about three times a day;

d. manually correcting the flow rate and the calorific value of the fuel gas in response to the marks in the numerical control applied in (b) and (c) above; and e. manually adjusting the stack draft in response to the flow rate and the calorific value of the fuel gas corrected as mentioned in (d) above, with reference to the past results and experience, to ensure efficient and substantially complete combustion of the fuel gas, and furthermore, analyzing the combustion waste gases with waste gas analyzers about once a week to further adjust manually the stack draft in response to said analysis values.

The above-mentioned method for controlling the combustion in a coke oven battery has the following problems:

1. The use of measured net coking times and measured flue temperatures of a low accuracy results in the difficulty in applying an appropriate combustion control; and 2. Measured net coking times are directly employed as a factor for controlling the flue temperature. However, because:

i. A coke oven battery shows a delay in thermal response of about 4 to 5 hours;

ii. A measured net coking time is a result of a thermal history over a period of about 18 to 20 hours from coal charging to coking completion for a coking oven; and iii. A mean measured net coking time is calculated for each of the coking oven for each work shift (at intervals of about eight hours) and is directly employed as a factor for controlling the flue temperature, but said mean value does not always represent net coking times for all the coking ovens;

this method leads to a considerable delay in thermal response of the coke oven battery, and the mutual dependence between the net coking time and the flue temperature results in a low combustion controllability. These facts eventually necessitate dependence on the human control by intuition;

3. In response to fluctuations in and outside the combustion system, such as the manual adjustment of the stack adjusting damper and the waste gas valves of the individual flues, changes in the fuel gas composition, the correction of the flow rate and calorific value of the fuel gas, variations of the atmospheric temperature, and the adjustment of the air damper, no adjustment of stack draft is applied, for keeping an appropriate air/fuel ratio.

4. The temperature of each flue varies with the carbonizing conditions and the carbonizing cycle dependent on the coke discharging pitches for the adjacent coking ovens. The overall mean flue temperature of the entire oven group also fluctuates under the effect of the unevenness of coke discharging pitches (for example, the unevenness of operational cycle between two oven groups, and that in operations caused by operational shutdown for repairing). A compensation and correction to be made in response to these changes are not taken into account in this method.

SUMMARY OF THE INVENTION

An object of the present invention is therefore to provide an improvement in the manual control of the combustion dependent on many factors, in the operation of a conventional coke oven battery.

A principal object of the present invention is to provide a method for controlling the combustion, with the use of a computer, in the operation of a conventional coke oven battery, which minimizes variations in the net coking time between individual coking ovens, permits improvement and stabilization of the quality of the product coke, and enables to save the energy and the labor.

In accordance with one of the features of the present invention, there is provided a method for controlling the combustion in the operation of a coke oven battery which comprises the steps of: setting a target flue temperature for each oven group on the basis of details of coal charge consisting of the weight, the particle size, the moisture content, the volatile matter content and the timing of charging of the coal charge, so as to achieve a target net coking time and a target soaking time given by a coke production schedule; measuring the temperatue at the hairpin tops of individual flues at certain intervals of time; calculating deviations of thus measured flue temperatures from said target flue temperature by computer to set a flow rate and a calorific value of the fuel gas for each oven group with the use of said deviations; setting a stack draft for each oven group by computer so as to ensure optimum combustion in response to changes in the flow rate and the calorific value of the fuel gas, and simultaneously adjusting said stack draft by means of a measured excess air ratio obtained by analyzing the combustion waste gases from the flues and a target excess air ratio; and bias-correcting said target flue temperature with reference to the mean value of the measured flue temperatures, the measured net coking times, the measured soaking times and the details of coal charge corresponding thereto.

BRIEF DESCRIPTION OF THE DRAWINGS

The present invention is illustrated by way of examples in the accompanying drawings which form part of this application and in which.

DETAILED DESCRIPTION OF PREFERRED EMBODIMENTS

First, the method for controlling the combustion for each oven group in the operation of a coke oven battery of the present invention is described.

Figure 1:
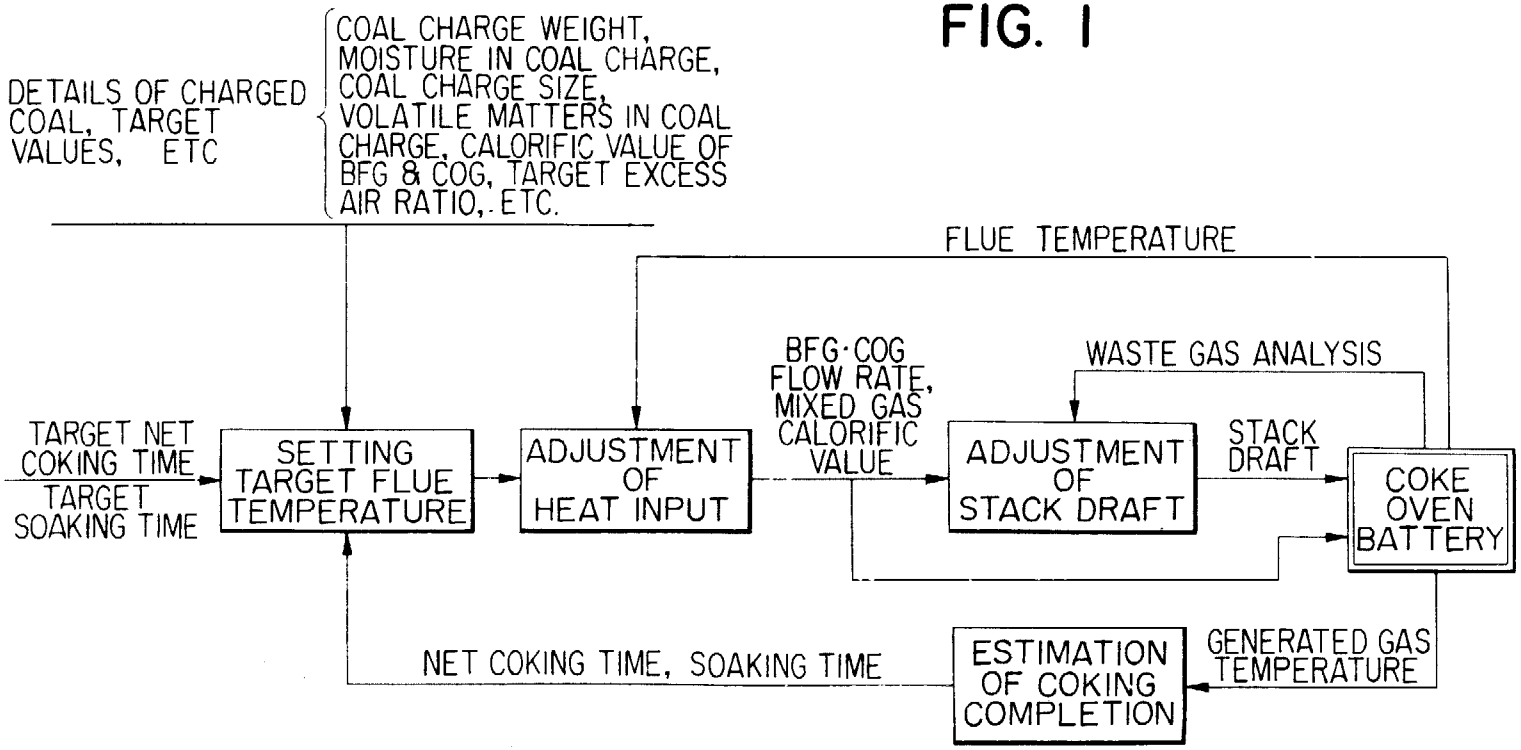
FIG. 1 is a block chart illustrating the method for controlling the combustion by oven group in the operation of a coke oven battery, of the present invention.

As shown in FIG. 1, a target flue temperature for each oven group is set on the basis of the details of coal charge consisting of the weight, the particle size, the moisture content, the volatile matter content and the timing of charging of the coal charge so as to achieve a target net coking time and a target soaking time given by a coke production schedule. Then, the temperature at the hairpin tops of individual flues is measured at certain intervals of time, preferably every 30 minutes or less, and deviations of thus measured flue temperatures from said target flue temperature are calculated by computer. The flow rate and the calorific value of the fuel gas (COG and/or BFG) for each oven group are automatically controlled in response to said deviations, and also, the stack draft for each oven group is automatically controlled so as to ensure optimum combustion in response to changes in the flow rate and the calorific value of the fuel gas.

The temperatures of the individual flues may be measured with satisfactory results in accordance with a method disclosed in Japanese Pat. Provisional Publication No. 66,183/74.

The stack draft is automatically controlled usually by continuously measuring $\%O_2$ and %CO in combustion waste gases with waste gas analyzers, as mentioned later, feeding back results of said measurement to a computer, and calculating an excess air ratio giving a normal air/fuel ratio. Net coking times and soaking times for the individual coking ovens are determined through the estimation of coking completion based on the temperature of generated gases from these coking ovens, and fed back to the computer.

A target flue temperature for each oven group is set in accordance with the following formula:

$$\bar{\theta}f = K_F + \frac{a}{\bar{T}c + \bar{T}s} + b\,\bar{\theta}\,c + \frac{c.\bar{M}.\bar{C}}{100} + d\bar{V} + e\bar{S} \quad (1)$$

where $\bar{\theta}f$: target flue temperature for the oven group (° C), $\bar{T}c$: target net coking time for the oven group (hr), $\bar{T}s$: target soaking time for the oven group (hr), $\bar{C}$: mean weight of coal charge for the oven group (Kg/coking oven), $\bar{M}$: mean moisture content in coal charge for the oven group (%), $\bar{V}$: mean volatile matter content in coal charge for the oven group (%), $\bar{S}$: mean particle size of coal charge for the oven group (%), $\bar{\theta}c$: estimated mean temperature of the contents of the coking ovens for the oven group (° C), and $a$, $b$, $c$, $d$, $e$ and $K_F$: coefficients.

In the present invention, the target flue temperature is bias-corrected for each oven group by correcting the constant term, $K_F$, in Eq. (1) mentioned above by means of the mean value of measured flue temperatures over a period of 24 to 48 hours, the measured net coking times, the measured soaking times, and the details of coal charge corresponding thereto, thereby giving a more accurate target flue temperature for each oven group.

Because the mean flue temperature for the entire oven group largely varies with the unevenness of the coke discharging pitch, this variation is compensated and corrected as follows in the present invention. The estimated mean temperature of the contents of the individual coking ovens can be approximately expressed by the following formula:

$$\theta\,c = 20 + 880\frac{t}{Tc} \quad (2)$$

where, $t$: time lapse from coal charging in a coking oven (hr), and

Tc: net coking time for said coking oven (hr).

As a carbonizing cycle consists of the cooling by coal charging and the progress of carbonization, i.e., the rise in the mean temperature of the contents of the coking oven, the change in the mean flue temperature for the entire oven group is attributable to the unevenness of the mean temperature of the contents in the coking ovens of the oven group. The estimated mean temperature, $\bar{\theta}c$, of the contents in the coking ovens of the oven group can therefore be expressed as follows:

$$\bar{\theta}\,c = \sum^{j=N} \theta\,cj/N \quad (3)$$

where,

N: number of coking ovens, and j: serial number of the coking oven.

Since the target flue temperature for the oven group in this case is expressed by Eq. (1) above, it is possible to compensate and correct a change in the mean flue temperature for the entire oven group by the substitution of $\bar{\theta}c$ obtained by Eq. (3) into Eq. (1).

The above-mentioned target flue temperature for the oven group can be set also from target flue temperatures for the individual flues. More specifically, the target flue temperature for a coking oven is calculated as follows:

$$\theta fj = [\theta fo + K_1\{ g(\theta c) - \frac{1}{\theta c^\circ - 20} \int_{20}^{\theta c^\circ} g(\theta c) d\theta c\} ]_j \quad (4)$$

where, $\theta fj$: time-series target flue temperature for a coking oven (° C), $\theta fo$: mean target flue temperature for said coking oven from coal charging to coke discharging (° C), $K_1$: constant, $g$: estimated wall temperature of said coking oven (° C), $\theta c$: estimated mean temperature of the contents in said coking oven at a moment (° C), $\theta c^\circ$: estimated coke discharging temperature for said coking oven (° C), $d$: integration element, and $j$: serial number of said coking oven.

It is therefore possible to set target flue temperatures for the individual flues by the following formula:

$$\theta fi = \frac{1}{i} (\theta fj + \theta fj + 1) \quad (5)$$

where, $i$: serial number of the flue in question.

A target flue temperature for the oven group can therefore be set by incorporating Eq. (4) into Eq. (5) to calculate the target flue temperatures for the individual flues and taking a mean of these temperatures.

In FIG. 1, the heat supply (the flow rate and the calorific value of the fuel gas) is set so as to minimize changes in the flue temperature and the heat supply, change in the flue temperature being considered as a temperature transient function incorporating the delay in thermal response.

As mentioned previously, the stack draft is automatically conrolled by continuously measuring $\%O_2$ and %CO in the combustion waste gases from the flues with waste gas analyzers (an $O_2$ analyzer and a CO analyzer) for continuous measurement installed in the stack, feeding back thus measured values to the computer for the calculation of an excess air ratio giving a normal air/fuel ratio, and thus deriving an appropriate stack draft well adapted to changes in the flow rate and the calorific value of the fuel gas and fluctuations in and outside the combustion system. However, because there is needed a time of two to three minutes before actual analysis by the waste gas analyzers of the combusion waste gases from the fuel gas having been subjected to said change, this delay in time is automatically corrected, and also, the stack draft is corrected by means of the target excess air ratio and the measured excess air ratio of the combustion waste gases, the latter of which as been fed back to the computer after measurement.

The estimation of coking completion in FIG. 1 may be carried out, for example, by a method disclosed in Japanese Patent Provisional Publication No. 103,902/74.

Now, the method for controlling the combustion for each flue in the operation of a coke oven battery of the present invention is described.

Figure 2:
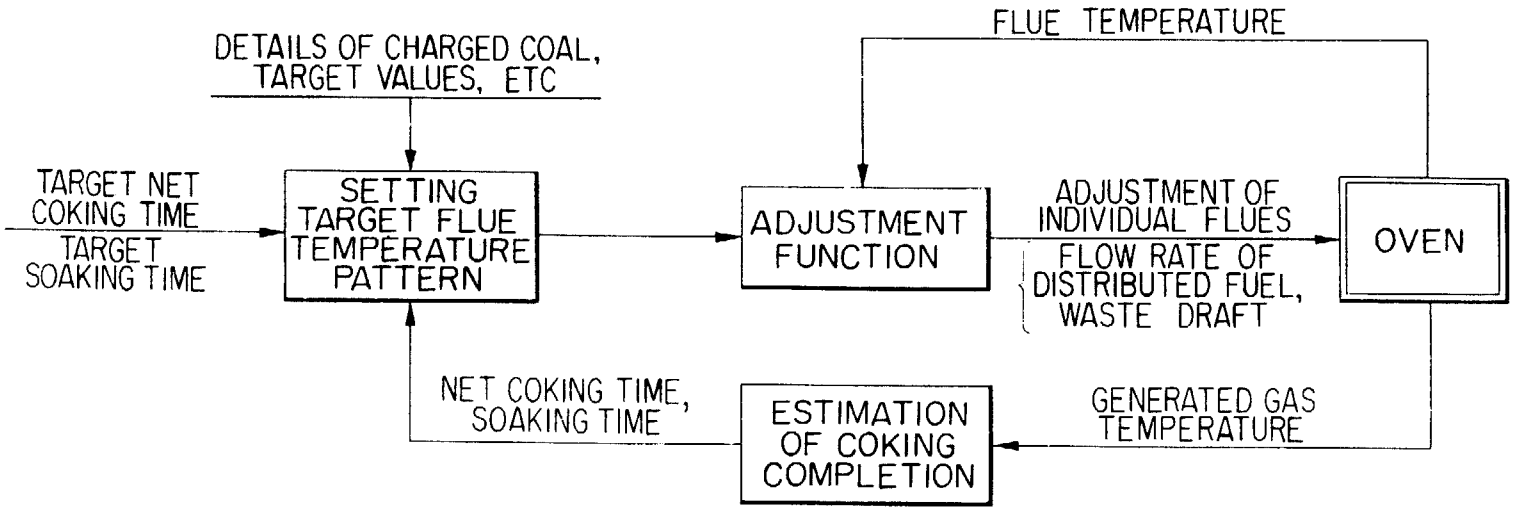
FIG. 2 is a block chart illustrating the method for controlling the combustion by flue in the operation of a coke oven battery, of the present invention.

As shown in FIG. 2, a target flue temperature pattern in a carbonizing cycle, i.e., in a cycle from coal charging to coke discharging, for each flue is set so as to achieve a target net coking time and a target soaking time given by a coke production schedule, on the basis of the details of coal charge consisting of the weight, the particle size, the moisture content, the volatile matter content and the timing of charging of the coal charge. Then, the temperature at the hairpin tops of individual flues is measured at certain intervals of time, preferably every 30 minutes or less, and deviations of thus measured flue temperatures from said target flue temperature pattern are calculated by computer. The flow rates and the calorific values of the fuel gas (BFG and/or COG) distributed to the individual flues are controlled in response to said deviations, and also, the combustion waste gas drafts for the individual flues are controlled so as to ensure optimum combustion in response to changes in the flow rates and the calorific values of the fuel gas. Furthermore, said target flue temperature pattern is biascorrected by means of the mean value of measured flue temperatures, the measured net coking times, the measured soaking times and the details of coal charge corresponding thereto, thereby giving a more accurate target flue temperature pattern.

The setting of a target flue temperature pattern, the adjustment of the combustion waste gas drafts for the individual flues, and the bias-correction of the target flue temperature patterns for the individual flues, as mentioned above, may be performed mutatis mutandis in accordance with the description given previously as to the combustion control for each oven group.

According to the present invention, as mentioned above, it is possible to largely solve the difficulties encountered in the conventional method for combustion control, and to reduce variations in the net coking time between coking ovens, which have been of the order of 33 to 35 minutes, to about 19 to 20 minutes. It is therefore possible to improve and stabilize the quality of product coke, to continue stable operations of a coke oven battery always kept in satisfactory conditions, and also to save the energy and the labor, thus providing industrially useful effects.

What is claimed is:

1. A method for controlling the combustion by oven group in the operation of a coke oven battery which comprises the steps of:

setting a target flue temperature for each oven group on the basis of the details of coal charge consisting of the weight, the particle size, the moisture content, the volatile matter content and the timing of charging of the coal charge, so as to achieve a target net coking time and a target soaking time given by a coke production schedule; measuring the temperature at the hairpin tops of individual flues at certain intervals of time; calculating deviations of thus measured flue temperatures from said target flue temperature by computer to set a flow rate and a calorific value of the fuel gas for each oven group with the use of said deviations; setting a stack draft for each oven group by computer so as to ensure optimum combustion in response to changes in the flow rate and the calorific value of the fuel gas, and simultaneously adjusting said stack draft by means of a measured excess air ratio obtained by analyzing the combustion waste gases from the flues and a target excess air ratio; and bias-correcting said target flue temperature with reference to the mean value of the measured flue temperatures, the measured net coking times, the measured soaking times and the details of coal charge corresponding thereto.

2. The method as claimed in claim 1, wherein said target flue temperature for each oven group is set in accordance with the following formula:

$$\bar{\theta} f = K_F + \frac{a}{\bar{T}c + \bar{T}s} + b\,\bar{\theta}\,C + \frac{c.\bar{M}.\bar{C}}{100} + d\bar{V} + e\bar{S}$$

where, $\bar{\theta}f$: target flue temperature for the oven group (° C),
$\bar{T}c$: target net coking time for the oven group (hr),
$\bar{T}s$: target soaking time for the oven group (hr),
$\bar{C}$: mean weight of coal charge for the oven group (Kg/coking oven),
$\bar{M}$: mean moisture content in coal charge for the oven group (%),
$\bar{V}$: mean volatile matter content in coal charge for the oven group (%),
$\bar{S}$: mean particle size of coal charge for the oven group (%),
$\bar{\theta}c$: estimated mean temperature of the contents of the coking ovens for the oven group (° C), and
*a, b, c, d, e* and $K_F$: coefficients.

3. The method as claimed in claim 1, wherein said target flue temperature for each oven group is set by calculating target flue temperatures for the individual flues through the substitution of Eq. (1) into Eq. (2) both given below and taking the mean of thus calculated target flue temperatures:

$$\theta fj = [\,\theta fo + K_1\{\,g(\theta c) - \frac{1}{\theta c^{\circ} - 20}\int_{g(\theta c)d\,\theta c}^{\theta c^{\circ}}\}\,]_j \qquad (1)$$

where, $\theta fj$: time-series target flue temperature for a coking oven (° C),
$\theta fo$: mean target flue temperature for said coking oven from coal charging to coke discharging (° C),
$K_1$: constant,
*g*: estimated wall temperature of said coking oven (° C),
$\theta c$: estimated mean temperature of the contents in said coking oven at a moment (° C),
$\theta c^{\circ}$: estimated coke discharging temperature for said coking oven (° C),
*d*: integration element, and
*j*: serial number of said coking oven; and $$\theta fi = \tfrac{1}{2}(\theta fj + \theta fj + 1) \qquad (2)$$

where,

*i* :serial number of the flue in question.

4. A method for controlling the combustion by flue in the operation of a coke oven battery which comprises the steps of:

setting a target flue temperature pattern in a carbonizing cycle, i.e., in a cycle from coal charging to coke discharging, for each flue so as to achieve a target net coking time and a target soaking time given by a coke production schedule, on the basis of the details of coal charge consisting of the weight, the particle size, the moisture content, the volatile matter content and the timing of charging of the coal charge; measuring the temperature at the hairpin tops of the individual flues at certain intervals of time; calculating deviations of thus measured flue temperatures from said target flue temperature pattern by computer to set flow rates and calorific values of the fuel gas distributed to the individual flues with the use of said deviations; setting combustion waste gas drafts for the individual flues by computer so as to ensure optimum combustion in response to changes in the flow rates and the calorific values of the distributed fuel gas, and simultaneously adjusting said combustion waste gas drafts by means of a measured excess air ratio obtained by analyzing the combustion waste gases from the flues and a target excess air ratio; and bias-correcting said target flue temperature patterns with reference to the mean value of the measured flue temperatures, the measured net cooking times, the measured soaking times and the details of coal charge corresponding thereto.

* * * * *